US005633493A

United States Patent [19]

Suzuki et al.

[11] Patent Number: 5,633,493

[45] Date of Patent: May 27, 1997

[54] IMAGE TUBE HAVING A YAG CRYSTAL

[75] Inventors: Hideki Suzuki; Minoru Kondo; Yasushi Watase; Yoshihito Suzuki, all of Hamamatsu, Japan

[73] Assignee: Hamamatsu Photonics K.K., Hamamatsu, Japan

[21] Appl. No.: 453,983

[22] Filed: May 30, 1995

[51] Int. Cl.[6] ..... H01J 40/14

[52] U.S. Cl. ..... 250/214 UT; 250/207; 313/524; 313/103 CM

[58] Field of Search ..... 250/214 UT, 214 LA, 250/207; 313/103 CM, 103 R, 105 CM, 105 R, 524, 468

[56] References Cited

U.S. PATENT DOCUMENTS

| | | | |
|---|---|---|---|
| 4,550,256 | 10/1985 | Befkstresser et al. | 250/483.1 |
| 4,713,577 | 12/1987 | Gualtieri et al. | 313/468 |
| 5,268,570 | 12/1993 | Kim | 250/214 VT |
| 5,338,927 | 8/1994 | de Groot et al. | 250/214 VT |
| 5,506,402 | 4/1996 | Estrera et al. | 250/214 VT |
| 5,510,588 | 4/1996 | Suzuki et al. | 250/207 |
| 5,510,673 | 4/1996 | Wodecki et al. | 313/524 |

FOREIGN PATENT DOCUMENTS

| | | |
|---|---|---|
| 60-144381 | 7/1985 | Japan . |
| 63-236250 | 10/1988 | Japan . |

*Primary Examiner*—Stephone Allen

*Attorney, Agent, or Firm*—Cushman Darby & Cushman, IP Group of Pillsbury Madison & Sutro, LLP.

[57] ABSTRACT

This image tube converts irradiated electrons into fluorescence by irradiating electrons converted from a light beam by a photocathode onto a YAG crystal member. Since the YAG crystal member is a single unitary solid, the fluorescence generated on the input surface of the YAG crystal member contains no fixed pattern noise.

12 Claims, 6 Drawing Sheets

IMAGE TUBE HAVING A YAG CRYSTAL

BACKGROUND OF THE INVENTION

1. Field of the Invention

The present invention relates to an image tube using the surface of a YAG crystal plate as a phosphor screen.

2. Related Background Art

An image tube, e.g., an X-ray image intensifier is applied to nondestructive inspection of a target object. A conventional image tube is disclosed in Japanese Patent Laid-Open No. 63-236250.

SUMMARY OF THE INVENTION

In an image tube of the present invention, electrons incident on a YAG crystal member which is disposed such that an input surface on which the electrons are incident opposes an electron multiplier are converted into fluorescence by the YAG crystal member. The fluorescence generated in the YAG crystal member emerges from the output surface thereof. Since the YAG crystal member is a single unitary solid, the fluorescence generated on the input surface of the YAG crystal member contains no fixed pattern noise. The output surface is exposed from the housing, and an atmospheric pressure is applied to the output surface. The distance from the input surface of the YAG crystal to the output surface, i.e., the thickness of the YAG crystal is 10 mm to 14.2 mm.

In manufacturing this apparatus, a fabricated YAG crystal member is fixed on a lid, and thereafter, this lid is fixed to the hosing by sealing. Only with this process, the second opening of the housing can be sealed by the YAG crystal member. Therefore, the manufacturing process can be simplified as compared to the manufacturing process of an image tube, which comprises coating of a fluorescent substance, formation of a nitrocellulose film, thermal decomposition, and the like.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENT

Figure 1:
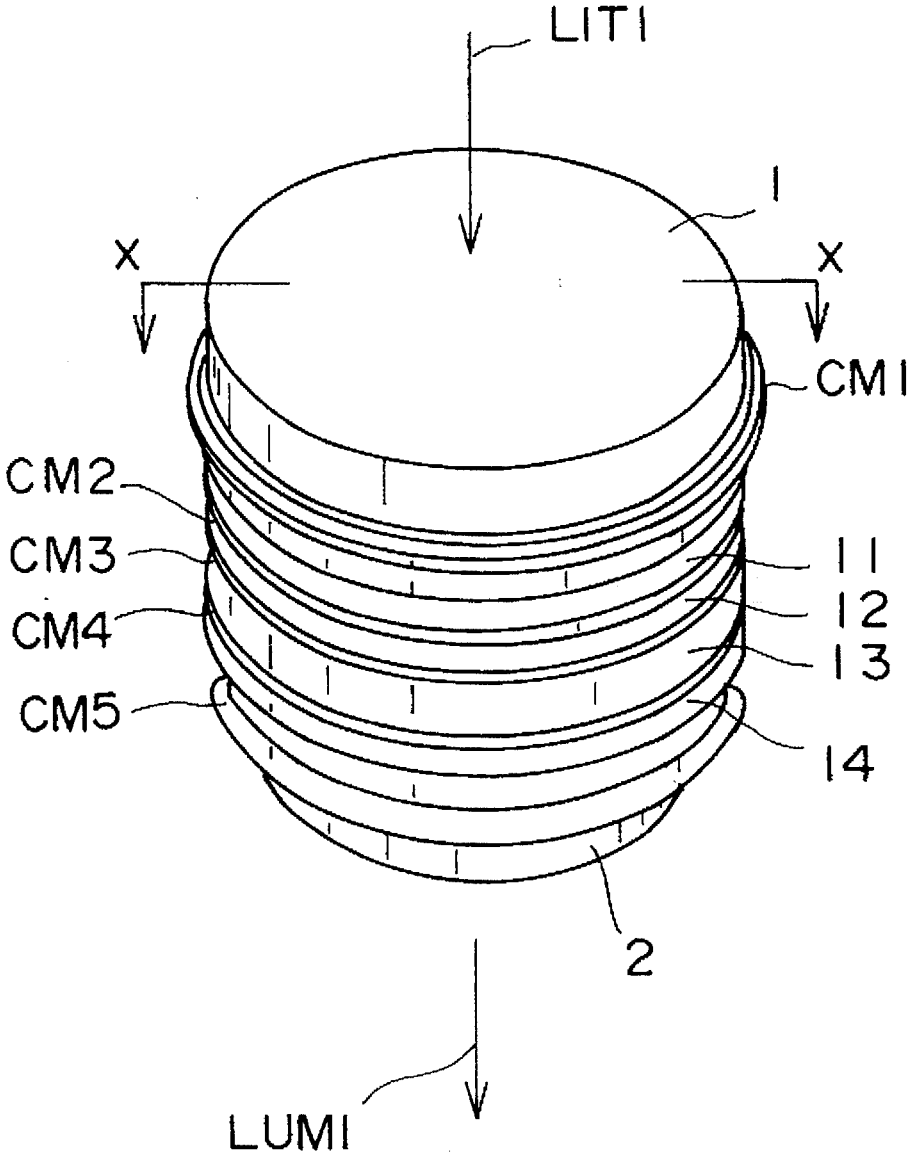
FIG. 1 is a view showing an image tube according to one embodiment of the present invention.

FIG. 1 is a view showing an image tube according to one embodiment of this invention.

This apparatus amplifies a light beam incident thereon and outputs the light beam. This apparatus has a housing having first and second openings, a transparent member for sealing the first opening, a photocathode, an electron multiplier, and a YAG crystal member for sealing the second opening.

Figure 2:
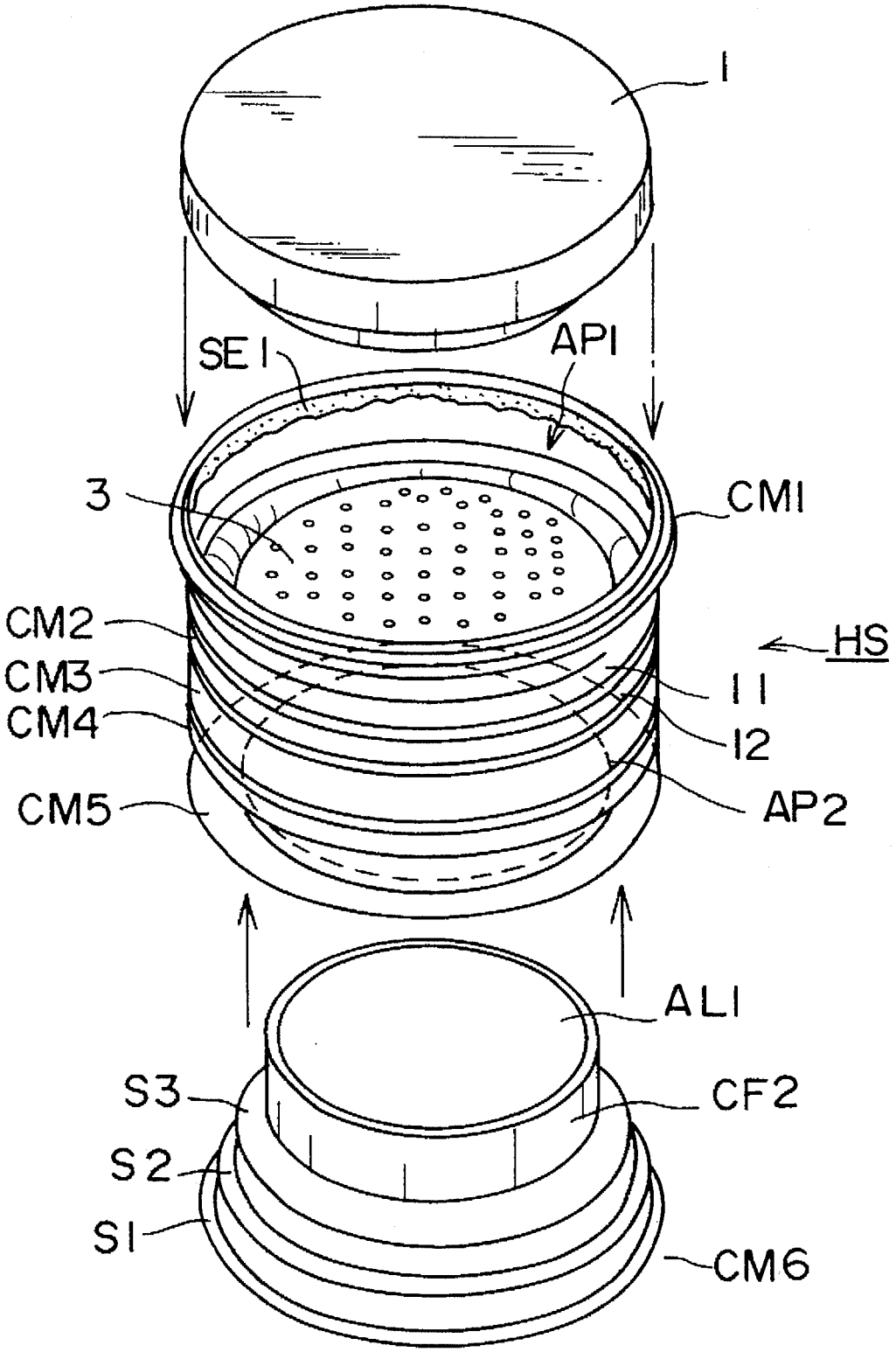
FIG. 2 is a view showing a state in which a transparent member and a YAG crystal member are fixed to a housing.

FIG. 2 is a view showing a state in which the transparent member and the YAG crystal member are fixed to the housing.

Figure 3:
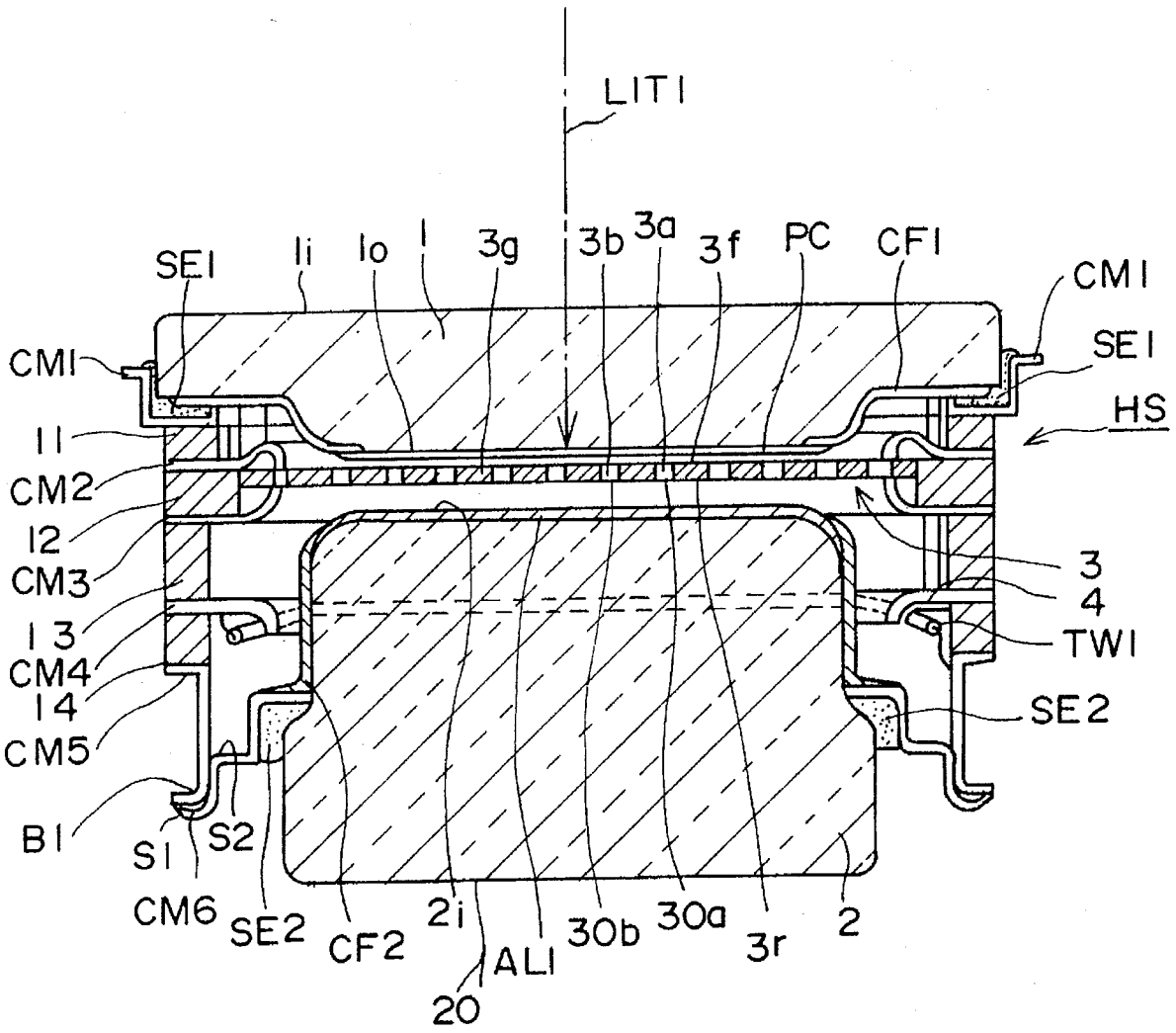
FIG. 3 is a sectional view of the image tube taken along a plane along the lines X—X in FIG. 1.

FIG. 3 is a sectional view of the image tube taken along a plane along the line X—X in FIG. 1. This plane includes the central axis of the image tube.

(Housing)

The housing comprises annular conductive members CM1 to CM4, a cylindrical conductive member CM5, and annular insulating members 11 to 14.

The first insulating member 11 is interposed between the first conductive member CM1 and the second conductive member CM2. The second insulating member 12 is interposed between the second conductive member CM2 and the third conductive member CM3.

The third insulating member 13 is interposed between the third conductive member CM3 and the fourth conductive member CM4. The fourth insulating member 14 is interposed between the fourth conductive member CM4 and the cylindrical conductive member CM5. An end portion B1 of the cylindrical conductive member CM5 is curved outward from the inside of the member CM5.

(Lid Member)

A lid member CM6 has a plurality of step portions S1 to S3, as shown in FIGS. 2 and 3. The lid member CM6 is fixed to the conductive member CM5 such that the step portion S1 matches the curved portion B1 of the conductive member CM5. The conductive members CM1 to CM6 are made of a material containing Cu. The insulating members 11 to 14 consist of glass. The conductive members CM1 to CM5 and the insulating members 11 to 14 are fixed to each other. Therefore, as shown in FIG. 2, the lid member CM6 seals a second opening AP2 of a housing HS together with a YAG crystal member 2.

(Transparent Member)

A transparent member 1 has a light incidence surface 1*i* for receiving a light beam (light image) LIT1 irradiated thereonto, and a light exit surface 1*o* opposing the light incidence surface, from which the light beam emerges. An atmospheric pressure is applied to the light incidence surface 1*i*. The transparent member 1 is comprised of glass. The light incidence surface 1*i* is almost flat. The light exit surface 1*o* is similarly almost flat. The transparent member 1 is circular. The transparent member 1 has a larger thickness near its central point than that in the periphery. The transparent member 1 is fixed to the conductive member CM1 at its periphery through a sealing material SE1. The conductive member CM1 is recessed at the center. The sealing material SE1 is introduced into this recessed portion. As shown in FIG. 2, the transparent member 1 seals a first opening AP1 of the housing HS through the sealing material SE1.

(Sealing Material for Fixing Transparent Member)

The sealing material SE1 is sealing frit glass (Corning 7578). The thermal expansion coefficient of the sealing frit glass SE1 is $7.6\times10^{-6}/°$ C.

(Photocathode)

A photocathode PC is fixed to the light exit surface lo and converts the light beam LIT1 passing through the transparent member 1 into electrons. The material of the photocathode layer PC is described in, e.g., U.S. Pat. No. 2,770,561. The photocathode layer PC covers the light exit surface 1*o* of the transparent member 1 to be electrically connected to a chromium conductive layer CF1.

(Chromium Layer for Biasing Photocathode)

The chromium layer CF1 is in contact with the transparent member 1. The chromium layer CF1 is located between the periphery of the photocathode layer PC and the transparent member 1. The chromium layer CF1 covers the periphery of the transparent member 1 on the light exit surface 1*o* side to be in contact with the first conductive member CM1. When a predetermined potential is applied to the first conductive member CM1, a potential lower than that of an aluminum backing electrode AL1 is applied to the photocathode PC through the chromium layer CF1.

(Electron Multiplier)

An electron multiplier 3 opposes the photocathode PC. Electrons incident on the electron multiplier 3 are multiplied and output therefrom. The electron multiplier 3 is formed of a microchannel plate (MCP). The microchannel plate 3 has a glass member 3*g* having a plurality of through holes 3*a* and 3*b*, and secondary emitters 30*a* and 30*b* respectively sticking on the inner walls of the through holes 3*a* and 3*b*. The through holes 3*a* and 3*b* extend through the glass member 3*g* in a direction of thickness. The thickness of the glass member 3*g* is defined by the distance between the upper surface and the lower surface. An electrode layer 3*f* for applying a predetermined potential to the secondary emitter on the upper surface side of the glass member is formed on the upper surface of the glass member 3*g*. An electrode layer 3*r* for applying a predetermined potential to the secondary emitter on the lower surface side of the glass member is formed on the lower surface of the glass member 3*g*.

(Structure for Fixing Electron Multiplier)

The electrode layer 3*f* of the electron multiplier 3 is in contact with the second conductive member CM2 to be electrically connected thereto. The electrode layer 3*r* of the electron multiplier 3 is in contact with the third conductive member CM3 to be electrically connected thereto.

The electron multiplier 3 is arranged between the second conductive member CM2 and the third conductive member CM3. The electron multiplier 3 is sandwiched between the second conductive member CM2 and the third conductive member CM3 so as to be fixed to the housing HS.

(YAG Crystal Member)

The YAG crystal member 2 consists of a YAG crystal, which is a single unitary solid. The YAG crystal member 2 has an input surface 2*i* and an output surface 2*o*.

The input surface 2*i* is almost flat and arranged in the housing HS while opposing the electron multiplier 3. The output surface 2*o* is located outside the housing Hs while opposing the input surface 1*i*. An atmospheric pressure is applied to the output surface 2*o*.

The YAG crystal member 2 is manufactured by fabricating a YAG crystal into a lid-like member and optically polishing the input surface 2*i* and the output surface 2*o*. The distance from the input surface 2*i* of the YAG crystal member 2 to the output surface 2*o*, i.e, the thickness of the YAG crystal member must be 10 mm to 14.2 mm.

(Backing Electrode)

The aluminum backing electrode or conductive layer AL1 is in contact with the input surface 2*i* of the YAG crystal member 2. The thickness of the aluminum layer AL1 is so small that electrons incident thereon pass therethrough. The A1 backing electrode AL1 prevents the fluorescence generated in the YAG crystal member 2 from being incident on the photocathode PC and the electron multiplier 3. The aluminum layer AL1 must have a thickness larger than 500 Å and smaller than 1000 Å to cause electrons to pass therethrough and prevent the fluorescence generated in the YAG crystal from being incident on the electron multiplier 3.

(Chromium Layer for Applying Potential to Backing Electrode)

A chromium layer CF2 is electrically connected to the aluminum layer AL1. The chromium layer CF2 covers the side surface of the YAG crystal member 2. The chromium layer CF2 is in contact with the lid member CM6 to be electrically connected thereto. Therefore, when a potential higher than that of the conductive member CM1 is applied to the conductive member CM5, a potential higher than that of the photocathode PC is applied to the backing electrode AL1 through the lid member CM6 and the chromium layer CF2.

(Sealing Material for Fixing YAG Crystal Member)

The YAG crystal member 2 is fixed to the lid member CM6 through sealing frit glass (Corning 7578) SE2. The YAG crystal member 2 has a thermal expansion coefficient almost equal to that of the sealing frit glass SE2. The thermal expansion coefficient of the YAG crystal member 2 is $8\times10^{-6}$ to $8.3\times10^{-6}$/° C. while that of the sealing frit glass SE2 is $7.6\times10^{-6}$/° C.

(Wire)

A metal wire TW1 is arranged in the housing HS. The wire TW1 is coated with titanium (Ti). The wire TW1 surrounds the YAG crystal member 2 along the inner wall of the annular insulating member 14. The wire TW1 is electrically connected to the conductive members CM4 and CM5. When a current flows through the wire TW1, the titanium sticking thereon partially sublimes to absorb air or water molecules in the housing.

(Shielding Member)

Diffusion of the sublimated titanium toward the electron multiplier 3 is shielded by the shielding member CM4 constituting part of the housing HS. The shielding member CM4 is arranged between the wire TW1 and the electron multiplier 3. The inside of the annular shielding member CM4 is curved toward the wire TW1. The wire TW1 is arranged in a space defined by the inside of the curved portion of the shielding member CM4.

(Titanium Layer)

A titanium layer 4 is arranged between the shielding member CM4 and the wire TW1 to stick to the shielding member CM4. The titanium layer 4 sticks to the inside of the curved portion of the shielding member CM4.

Figure 4:
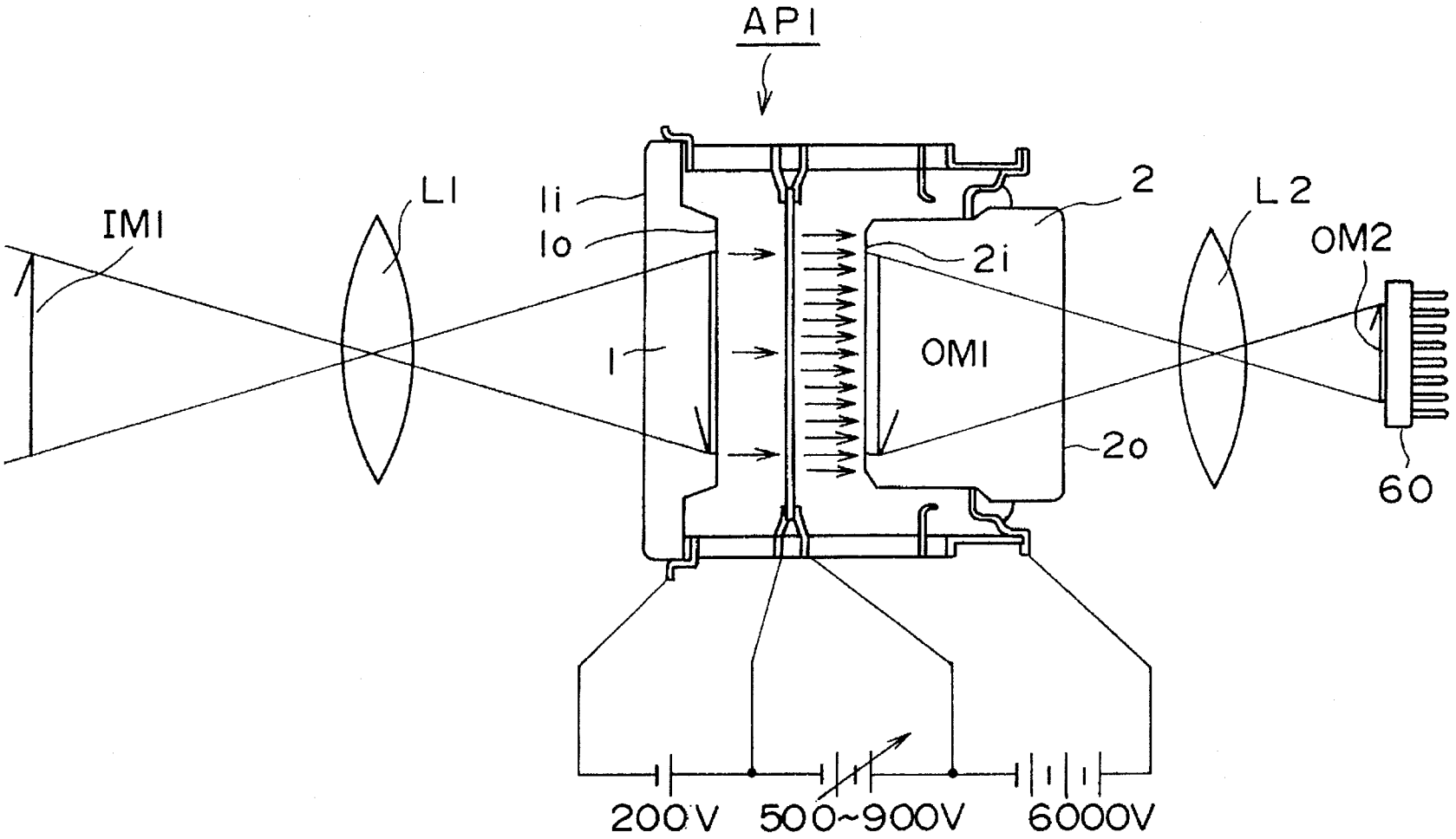
FIG. 4 is a view showing the image tube shown in FIG. 3, a CCD image pickup device, and two lenses.

FIG. 4 shows a system in which lenses L1 and L2 and a CCD 60 are combined with an apparatus AP1 shown in FIG. 1.

The first lens (first lens system) L1 is arranged in front of the transparent member. An image IM1 passing through the first lens L1 is focused on the light exit surface lo of the transparent member 1. Electrons generated in the photocathode PC in correspondence with incidence of the image IM1 on the photocathode PC are irradiated onto the input surface 2*i* of the YAG crystal member 2 while continuously holding the image information. The electronic image irradiated onto the YAG crystal member 2 is converted into a fluorescent image by the YAG crystal. The fluorescent image passes through the second lens (second lens system) L2 and is focused on the CCD image pickup element 60.

(Operation)

The operation of this apparatus will be described below. The incident optical image IM1 focused on the photocathode PC by the lens system L1 is converted into photoelectrons.

A voltage of 200 V is applied between the photocathode PC and the front surface electrode 3*f* of the electron multiplier 3, and the photoelectrons generated in the photocathode PC are guided into the electron multiplier 3. A voltage of 500 to 900 V is applied between the front surface electrode 3*f* of the electron multiplier 3 and the rear surface electrode 3*r*, and the photoelectrons guided into the electron multiplier 3 are multiplied in the electron multiplier 3. A voltage of 6,000 V is applied between the rear surface electrode 3*r* of the electron multiplier 3 and the aluminum backing electrode AL1, and the photoelectrons multiplied in the electron multiplier 3 are guided into the YAG crystal member 2. The YAG crystal member 2 emits light upon incidence of the photoelectrons. An output optical image OM1 corresponding to the incident optical image IM1 is generated in the YAG crystal member 2 as an optical image. The output optical image OM1 passes through the YAG crystal member 2 and is radiated from the output surface 2*o*. The output optical image OM1 radiated in this manner is focused on the CCD 60 through the lens system L2. An output image OM2 obtained upon photoelectric conversion in the CCD 60 is output from the CCD 60 as a video signal.

In this embodiment, the CCD 60 is arranged behind the lens system L2 to electrically process the output image. However, the output image may be visually observed from the back of the lens system L2.

(Advantage)

Figure 5:
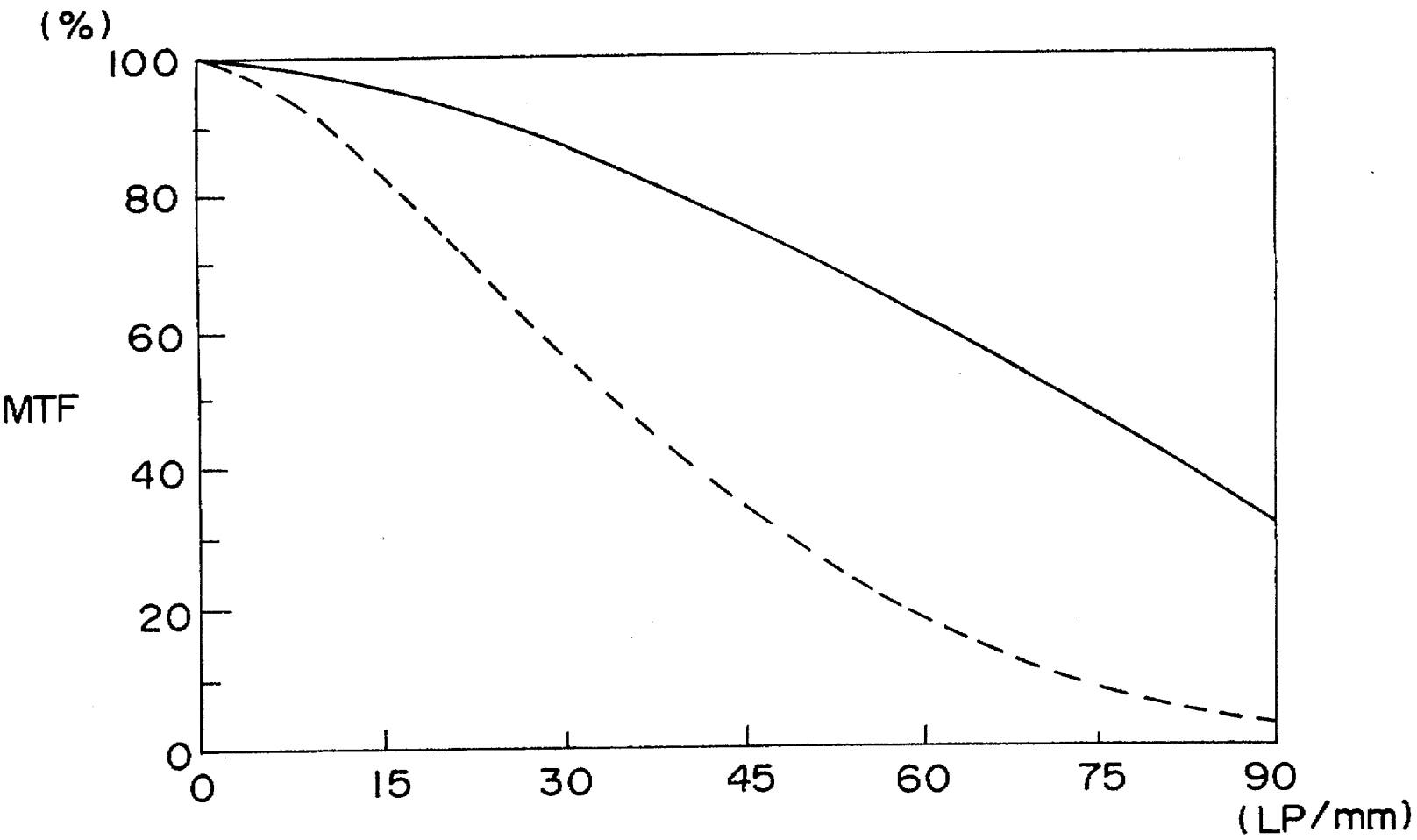
FIG. 5 is a graph showing a modulation transfer function (MTF) on a light-emitting surface.
Figure 6:
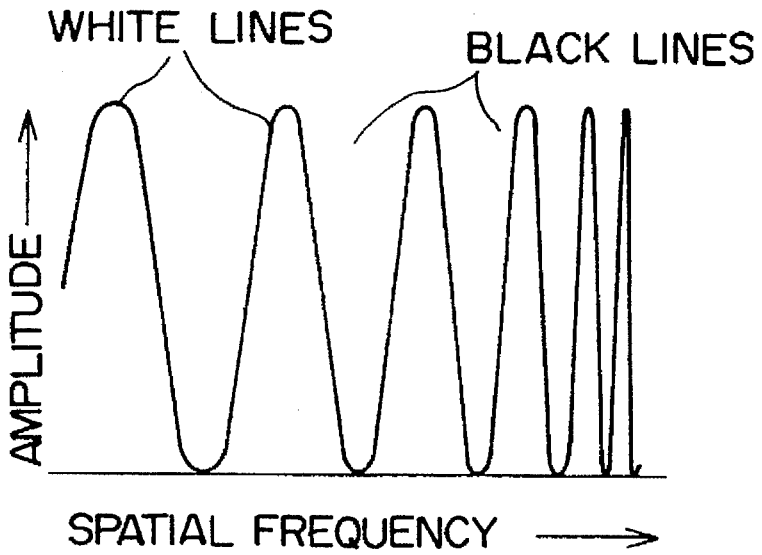
FIGS. 6 and 7 are views for explaining the MTF.
Figure 7:
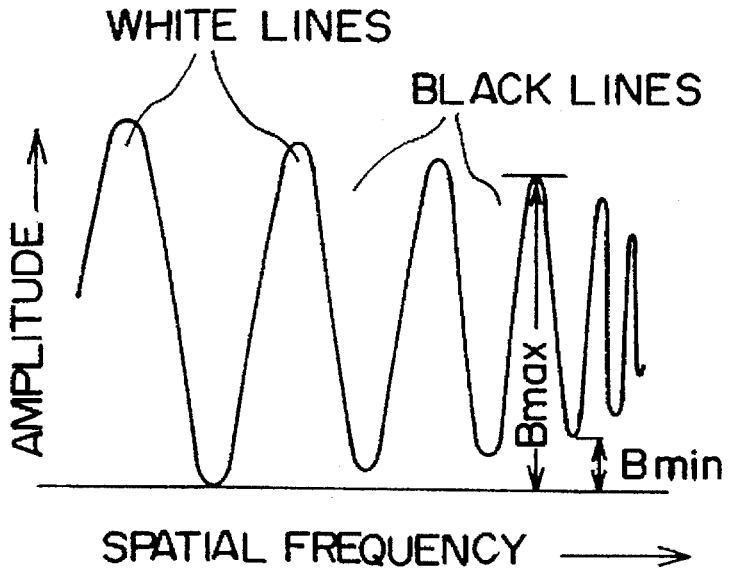

FIG. 5 is a graph showing a modulation transfer function (MTF) (solid line) on the input surface (light-emitting surface) 2*i* of the YAG crystal member 2 of this apparatus and an MTF (dotted line) on a powder fluorescent surface. FIGS. 6 and 7 are views for explaining the MTF. When the input optical image shown in FIG. 6 is incident on a fluorescent substance, the intensity of the output optical image is modulated by the fluorescent substance for each spatial frequency, as shown in FIG. 7. The half-width of a white line at a predetermined spatial frequency in FIG. 6 is defined as a resolution LP/mm. The intensity of the output optical image at the maximum value of the white line at a predetermined spatial frequency is represented by Bmax, and the intensity of the output optical image at the minimum value of a black line adjacent to the white line is represented by Bmin. The MTF is given as MTF=(Bmax−Bmin)/(Bmax+Bmin). As shown in FIG. 5, the MF curve of the YAG crystal member 2 represents a higher resolution than that on the powder phosphor screen.

(Manufacturing Method)

A method of manufacturing the apparatus shown in FIG. 1 will be described below. First of all, the annular conductive member CM6 is prepared. The YAG crystal member 2 formed of the YAG crystal is prepared. The photocathode PC is deposited on the transparent member 1. The electron multiplier 3 is fixed in the housing HS. The wire TW1 covered with titanium is arranged in the housing HS. The sealing material SE1 is introduced between the conductive member CM6 and the YAG crystal member 2. The sealing material SE1 is hardened to fix the YAG crystal member 2 to the conductive member CM6. As shown in FIG. 2, the conductive member CM6 is fixed to the housing HS, and the transparent member 1 is fixed to the housing HS, thereby sealing the housing HS.

A current is caused to flow through the wire TW1 to heat the wire TW1. The titanium sticking to the wire TW1 sublimes to absorb the gas molecules in the apparatus. Therefore, the pressure in the housing HS is decreased. Since the shielding member CM4 is arranged between the wire TW1 and the electron multiplier 3, the titanium is deposited on the shielding member CM4.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An apparatus for amplifying a light beam incident thereon to output the light beam, comprising:

(A) a housing having first and second openings;

(B) a transparent member for sealing the first opening, said transparent member having, (a) a light incidence surface applied with an atmospheric pressure, onto which the light beam is irradiated, and (b) a light exit surface opposing said light incidence surface, from which the light beam emerges;

(C) a photocathode, fixed on said light exit surface, for converting the light beam into electrons;

(D) an electron multiplier, opposing said photocathode, for multiplying the electrons incident thereon; and (E) a YAG crystal member for sealing the second opening, said YAG crystal member comprising a YAG crystal as a single unitary solid and having (a) an input surface opposing said electron multiplier and arranged in said housing, and (b) an output surface opposing said input surface and located outside said housing, on which an atmospheric pressure is applied.

2. An apparatus according to claim 1, wherein said electron multiplier is a microchannel plate.

3. An apparatus according to claim 1, wherein said electron multiplier is a microchannel plate having a glass member having a plurality of through holes and secondary emitters sticking to inner walls of the through holes.

4. An apparatus according to claim 1, further comprising an aluminum layer in contact with said input surface of said YAG crystal member.

5. An apparatus according to claim 1, wherein said apparatus further comprises an aluminum layer in contact with said input surface of said YAG crystal member and a chromium layer electrically connected to said aluminum layer.

6. An apparatus according to claim 1, further comprising an aluminum layer in contact with said input surface of said YAG crystal member and a chromium layer electrically connected to said aluminum layer and in contact with said YAG crystal member.

7. An apparatus according to claim 1, further comprising a metal wire arranged in said housing and coated with titanium said metal wire adapted and constructed to receive a current to absorb air or water molecules from within said housing.

8. An apparatus according to claim 1, further comprising a wire arranged in said housing, a shielding member arranged between said wire and said electron multiplier, and a titanium layer arranged between said shielding member and said wire and sticking to said shielding member.

9. An apparatus according to claim 1, wherein a distance from said input surface to said output surface of said YAG crystal member is set such that fluorescence generated in said YAG crystal member in response to incidence of the electrons from said electron multiplier on the YAG crystal does not contain a fixed noise pattern.

10. An apparatus according to claim 1, wherein a distance from said input surface to said output surface of said YAG crystal member is larger than 10 mm and smaller than 14.2 mm.

11. An apparatus for amplifying a light beam incident thereon to output the light beam, comprising:

(A) a housing;

(B) a transparent member fixed to said housing, said transparent member having, (a) a light incidence surface onto which the light beam is irradiated, and (b) a light exit surface opposing said light incidence surface, from which the light beam emerges;

(C) a photocathode, fixed on said light exit surface, for converting the light beam into electrons;

(D) an electron multiplier, opposing said photocathode, for multiplying the electrons incident thereon; and (E) a YAG crystal member fixed to said housing, said YAG crystal member comprising a YAG crystal as a single unitary solid and having (a) an input surface opposing said electron multiplier and arranged in said housing, and (b) an output surface opposing said input surface and located outside said housing so that a distance from said input surface to said output surface of said YAG crystal member is larger than 10 mm and smaller than 14.2 mm.

12. An apparatus according to claim 11, wherein a distance from said input surface to said output surface of said YAG crystal member is set such that fluorescence generated in said YAG crystal member in response to incidence of the electrons from said electron multiplier on the YAG crystal does not contain a fixed noise pattern.

* * * * *